US005411117A

United States Patent [19]

Häyrinen

[11] Patent Number: 5,411,117

[45] Date of Patent: May 2, 1995

[54] SAFETY DEVICE ARRANGEMENT

[75] Inventor: Seppo Häyrinen, Helsinki, Finland

[73] Assignee: Kone Elevator GmbH, Baar, Switzerland

[21] Appl. No.: 85,878

[22] Filed: Jul. 6, 1993

[30] Foreign Application Priority Data

Jul. 7, 1992 [FI] Finland ..... 923114

[51] Int. Cl.[6] ..... B66B 5/16

[52] U.S. Cl. ..... 187/360; 187/345

[58] Field of Search ..... 187/76, 75, 1 R, 67; 248/581, 580, 603

[56] References Cited

U.S. PATENT DOCUMENTS

| | | | |
|---|---|---|---|
| 2,704,608 | 3/1955 | Graf et al. | 187/76 |
| 2,856,028 | 10/1958 | Racely | 187/76 |
| 3,477,548 | 11/1969 | Trollope et al. | 187/29 |
| 3,768,596 | 10/1973 | Solymos | 187/67 |
| 5,005,671 | 4/1991 | Aime et al. | 187/1 R |

FOREIGN PATENT DOCUMENTS

| | | | |
|---|---|---|---|
| 81212 | 6/1983 | European Pat. Off. . | |
| 457455 | 9/1913 | France . | |
| 396262 | 6/1983 | France . | |
| 199504 | 3/1907 | Germany . | |
| 1431865 | 11/1968 | Germany | 187/1 R |
| 2201735 | 7/1973 | Germany . | |
| 2460337 | 7/1976 | Germany . | |
| 17479 | 8/1907 | Norway . | |

*Primary Examiner*—Kenneth W. Noland

[57] ABSTRACT

A safety device arrangement for stopping the downward drift of an elevator car (1) has a controllable arrester (10) mounted on the supporting frame (7) of an elevator car. The arrangement is provided with latches (20), and for each latch a stop block (26) is immovably mounted in the elevator shaft (3). The arrangement comprises buffer elements (13) placed between the arrester (10) and the supporting frame (7) of the elevator car. When the elevator car rests on latches (20) engaged by stop blocks (26), the resulting supporting forces are passed between the car frame (7) and the arrester (10) substantially only through the buffer elements (13).

19 Claims, 4 Drawing Sheets

SAFETY DEVICE ARRANGEMENT

FIELD OF THE INVENTION

The present invention relates to a safety device arrangement for stopping the downward drift of an elevator car.

DESCRIPTION OF THE BACKGROUND ART

Direct-acting hydraulic elevators have generally been used for the transport of heavy goods, for which purpose they are well suited. Their rated loads are many times or even several tens of times higher than those of hydraulic passenger elevators. Direct-acting hydraulic elevators generally do not need a safety gear for the stopping of uncontrolled fall of the elevator car because the hydraulic cylinders are provided with throttles limiting the outflow of the hydraulic fluid so that the speed of the elevator car cannot exceed a safe value. Thus, the elevator car descends slowly along the shaft to the lowest position of its travel. The problem with these elevators is not the danger of the elevator car falling down, but a situation where the elevator car drifts slowly downwards from the door zone, so that the threshold between the floor of the elevator car and the landing floor becomes too high. There are many reasons for this slow drift. A common case is one in which the hydraulic fluid for some reason gradually "leaks" out of the lifting cylinder, with the result that, if the elevator is not used for a long period, the car drifts downwards from the floor level. To prevent this downward drift, the elevator car is provided with arresters or other gripping devices designed to prevent the car from moving down from the floor level. These devices for preventing downward drift must be of a strong design as they have to withstand the possibly unevenly distributed strain imposed by the load and also the changes of load resulting from the loading or unloading of the car. As arresters like this are rigidly fixed to the elevator car, their use for the stopping of the elevator from full speed cannot be considered a good solution because of the fairly high deceleration occurring in these cases.

SUMMARY OF THE INVENTION

To solve the problem described above, a new type of safety device arrangement is presented as an invention.

The safety device arrangement of the invention for stopping the downward drift of an elevator car is characterized by at least one buffer element is placed between the arrester and the supporting frame of the elevator car. When the elevator car rests on at least one latch which is engaged by stop blocks on the elevator shaft, the resulting supporting forces are passed between the car frame and the arrester substantially only through the at least one buffer element.

The invention provides e.g. the advantage that, when the elevator car rests on the latches of the arrester, the stress imposed by it on the latches is evenly distributed. Consequently, no special measures are required to start the elevator moving after being arrested by the latches. It only has to be moved up through some distance to release the latches. Another advantage is that, when the elevator is stopped from a normal travelling speed by means of the safety device arrangement, the deceleration is effected by means of buffers. The average deceleration is determined by the buffer stroke length corresponding to the momentary load and by the initial speed of the elevator car when arrested by the safety device arrangement. The instantaneous deceleration value depends especially on the characteristics of the buffer elements selected. For example, a spring buffer provides progressive deceleration in relation to the stopping distance. A sufficient stopping distance in relation to the nominal speed of the elevator is easily achieved by using buffer elements with a suitable free stoke length. The sliding guide shoes of the arrester eliminate the risk of the arrester slipping aside from under the car. The safety device arrangement of the invention can also be quite easily installed on elevators already in use. As the arrester comprised in the safety device arrangement contains a buffer function in itself, no separate buffers need to be installed at the bottom of the elevator shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the following, the invention is described in detail by the aid of an example by referring to the attached drawings which are given by way of illustration only, and thus are not limitative of the present invention, and in which.

DETAILED DESCRIPTION OF THE PREFERRED EMBODIMENTS

Figure 1:
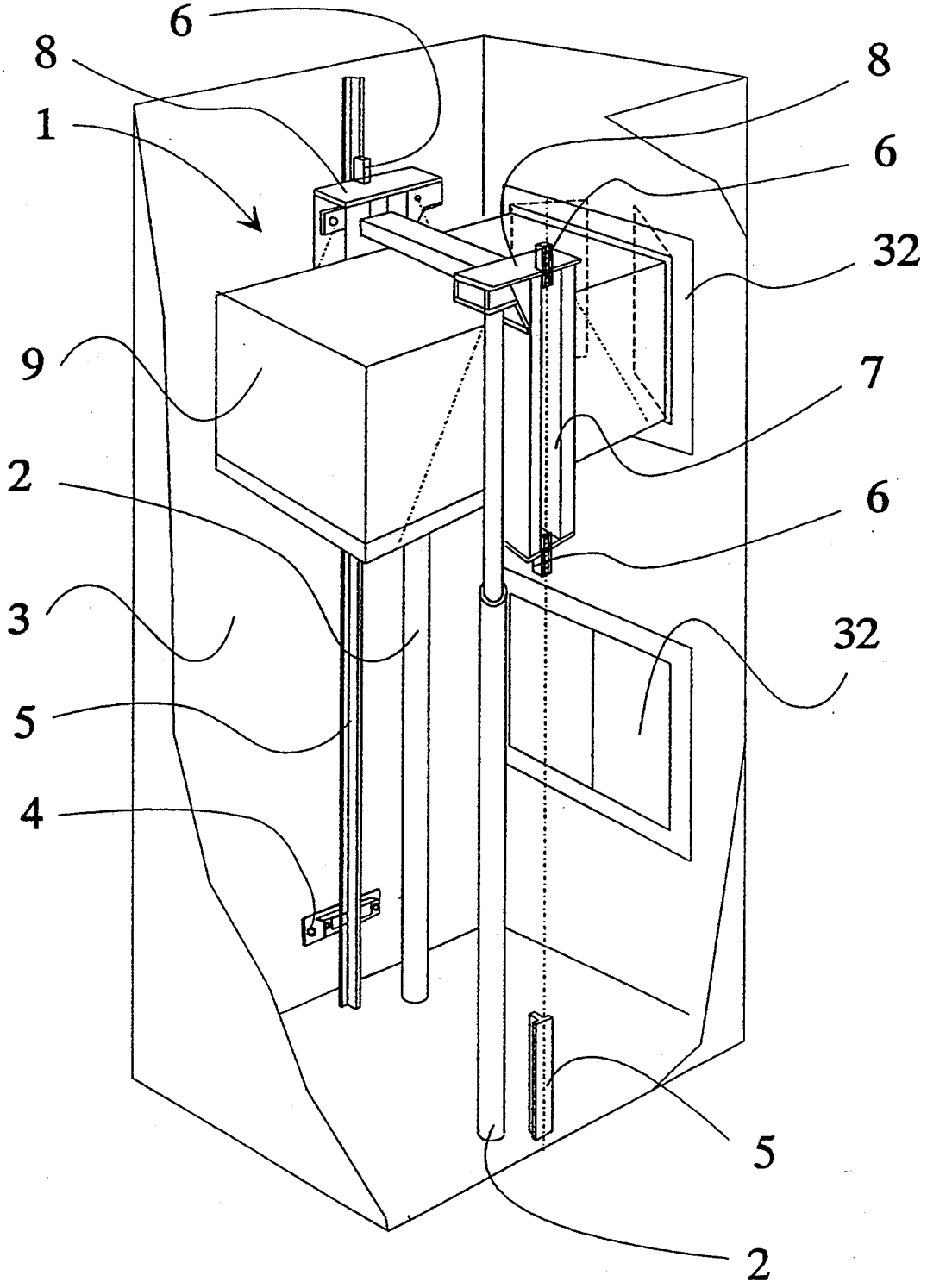
FIG. 1 shows a direct-acting hydraulic elevator to which the invention can be applied.

FIG. 1 shows a direct-acting hydraulic elevator for the transport of goods, in which the force of the hydraulic cylinders 2 imparting vertical motion to the elevator car 1 is applied to the car structures directly, not e.g. via hoisting ropes. The elevator car moves along guide rails 5 fixed with rail clamps 4 to the walls of the elevator shaft 3. The guide rails guide the elevator car by means of sliding guide shoes 6. The car frame 7 of this elevator comprises two lifting supports 8. The elevator car rests on the lifting supports on top of the lifting cylinders 2. The supporting force producing vertical motion of the car is generated by the lifting cylinders 2 and applied to the car via the lifting supports 8. The cabin 9 of the elevator car 1 is fitted inside the car frame 7. The elevator car and the landings are provided with doors 32.

Figure 2:
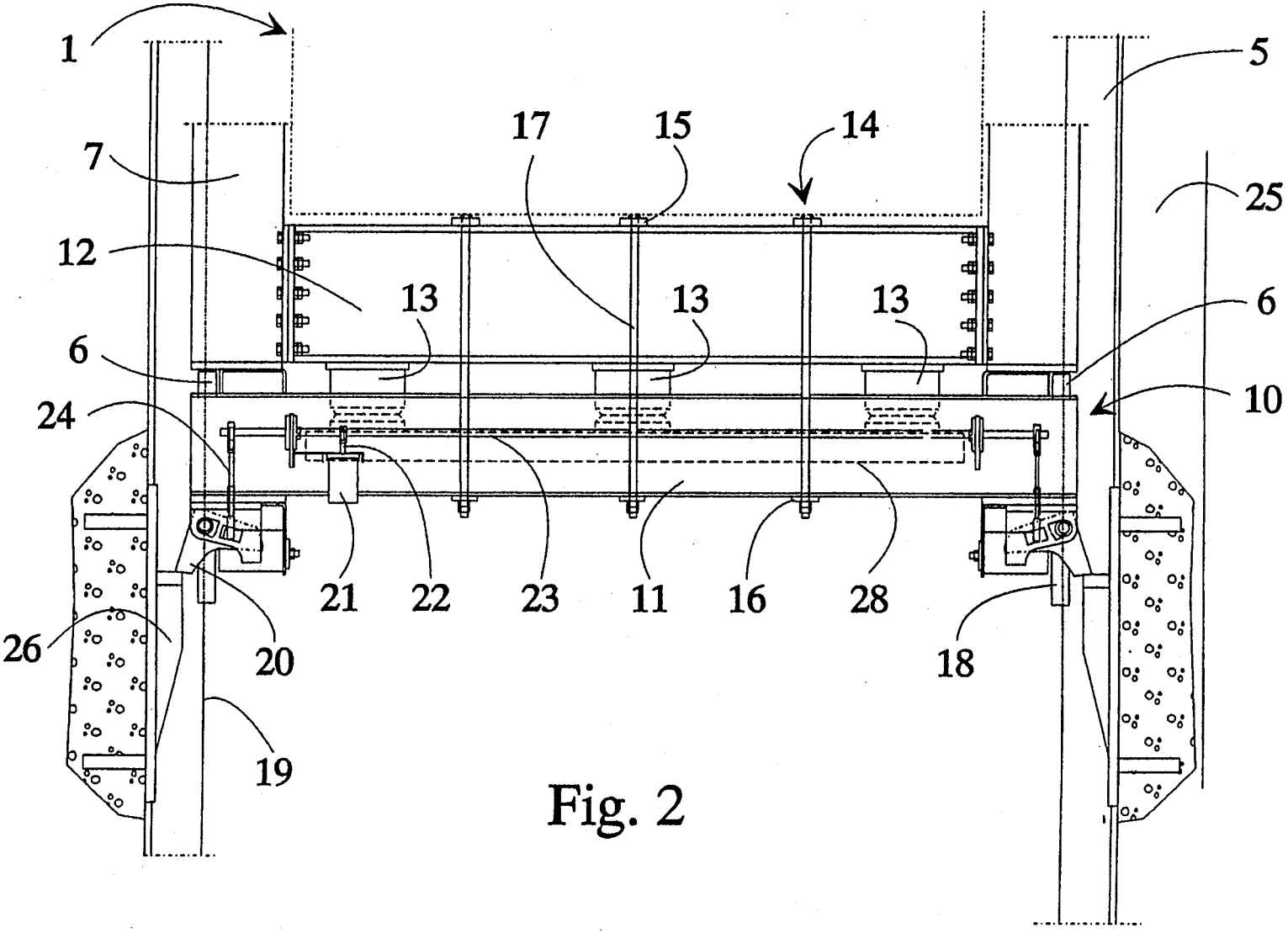
FIG. 2 shows a lateral view of an arrester included in the safety device arrangement of the invention.

FIG. 2 presents an arrester 10 mounted under an elevator car 1 (only the lower part of the car is shown in the figure). Placed between the frame beam 11 of the arrester and the bottom beam 12 of the car frame 7 are buffer elements 13. The buffer elements are attached by one end to the bottom beam 12 of the car frame and to the arrester frame 11 by the other end. The largest distance between the arrester and the car frame bottom beam is determined by binders 14 placed around the arrester, each of which consists of a flat iron bar 15 placed on top of the car frame bottom beam 12 and another flat iron bar 16 placed under the arrester and two tie bolts 17 connecting the flat iron bars on top of the car frame bottom beam and under the arrester, said bolts passing by the sides of the bottom beam 12 and the arrester 10, one bolt on each side. Each end of the arrester 10 is provided with a sliding guide shoe 18, mounted so that they follow the same guide rail 5 as the elevator guide shoes 6 on the corresponding side of the car 1. The sliding guide shoes 18 of the arrester prevent the latter from slipping from under the car frame, so the joint arrester between the arrester and the car frame need not be very rigid in the horizontal direction. This means that a relatively simple structure can be used to join the arrester and the car frame. In the figure, the tongues of the guide rails are indicated by reference number 19. The arrester 10 has four latches 20, two on each side. The latches 20 on each side are actuated by means of lifting magnets 21 placed on the sides of the arrester. The spindle 22 of the lifting magnet turns an axle 23, which again turns the latch by means of a lever 24 either to a travel position or to an arrest position. To visualize the operation of the arrester 10, the latches 20 of the arrester are shown in the arrest position and the elevator car 1 in a position where the latches have caught on stop blocks 26 provided in the wall 25 of the elevator shaft. In reality, all four latches of the arrester operate substantially simultaneously. However, in the situation presented by the figure, the weight of the elevator car is substantially carried by the hydraulic cylinders 2, as is indicated by the fact that the buffer elements 13 are not much compressed and that there is no gap between the binders 14 and the arrester. The arrest position is the rest position of the latches 20, which return to this position even in the event of power failure. The return of the latches can be ensured by mounting a return spring (not shown in the figures) in conjunction with the lifting magnet, levers or latches. The latches of the arrester are in the travel position only when the elevator car is travelling. When the car sets off from a situation where it has been supported by the latches 20 on the stop blocks 26 in the shaft walls, it is preferable first to let the car run upwards through some distance and only then to turn the latches of the arrester into the travel position. To obtain an indication of whether the elevator car is resting on the latches, it is easy to provide the arrester with a suitable sensor, e.g. a switch placed between the arrester and the car frame. The drawings do not show a sensor.

Figure 3:
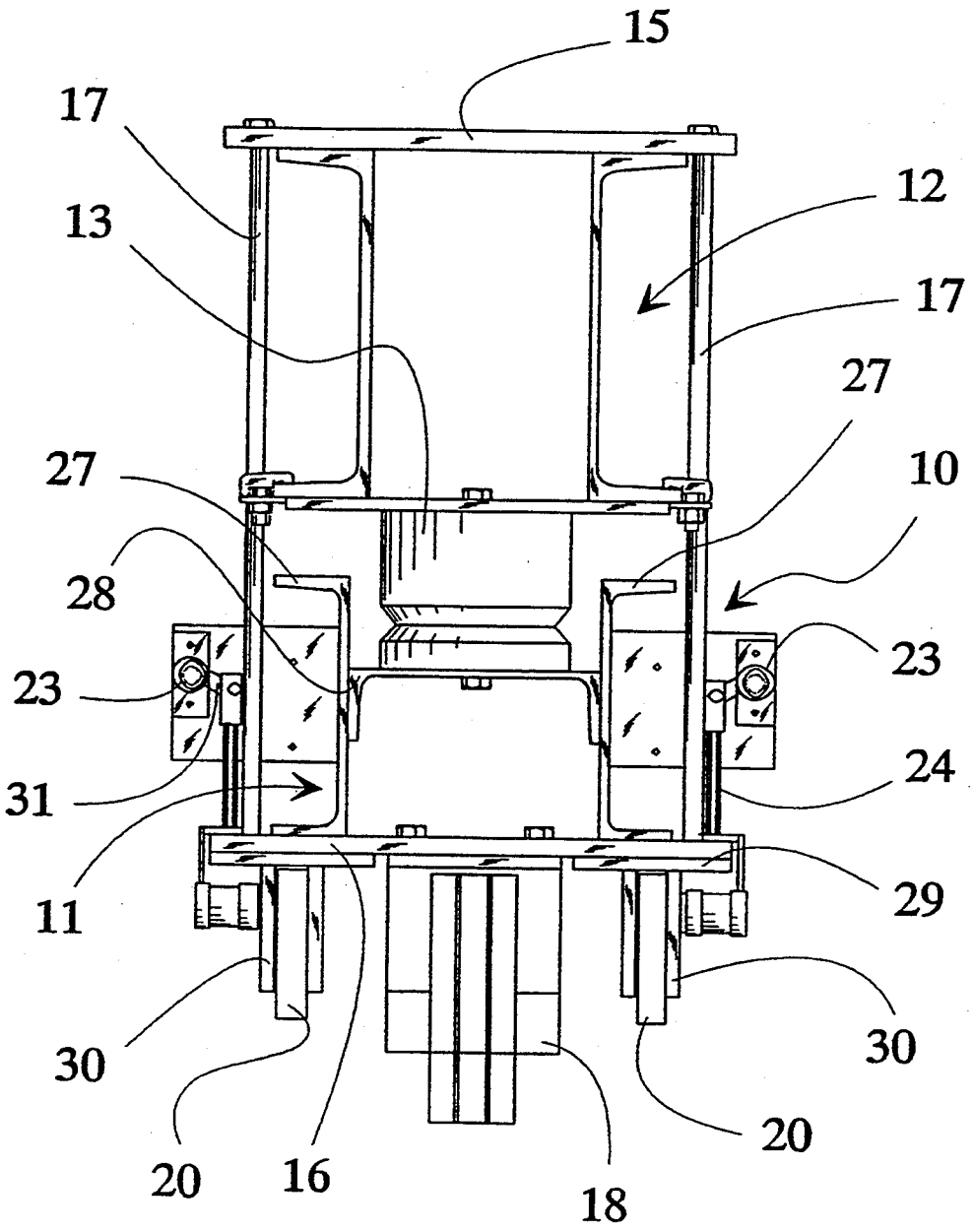
FIG. 3 shows an end view of an arrester included in the safety device arrangement of the invention.
Figure 4:
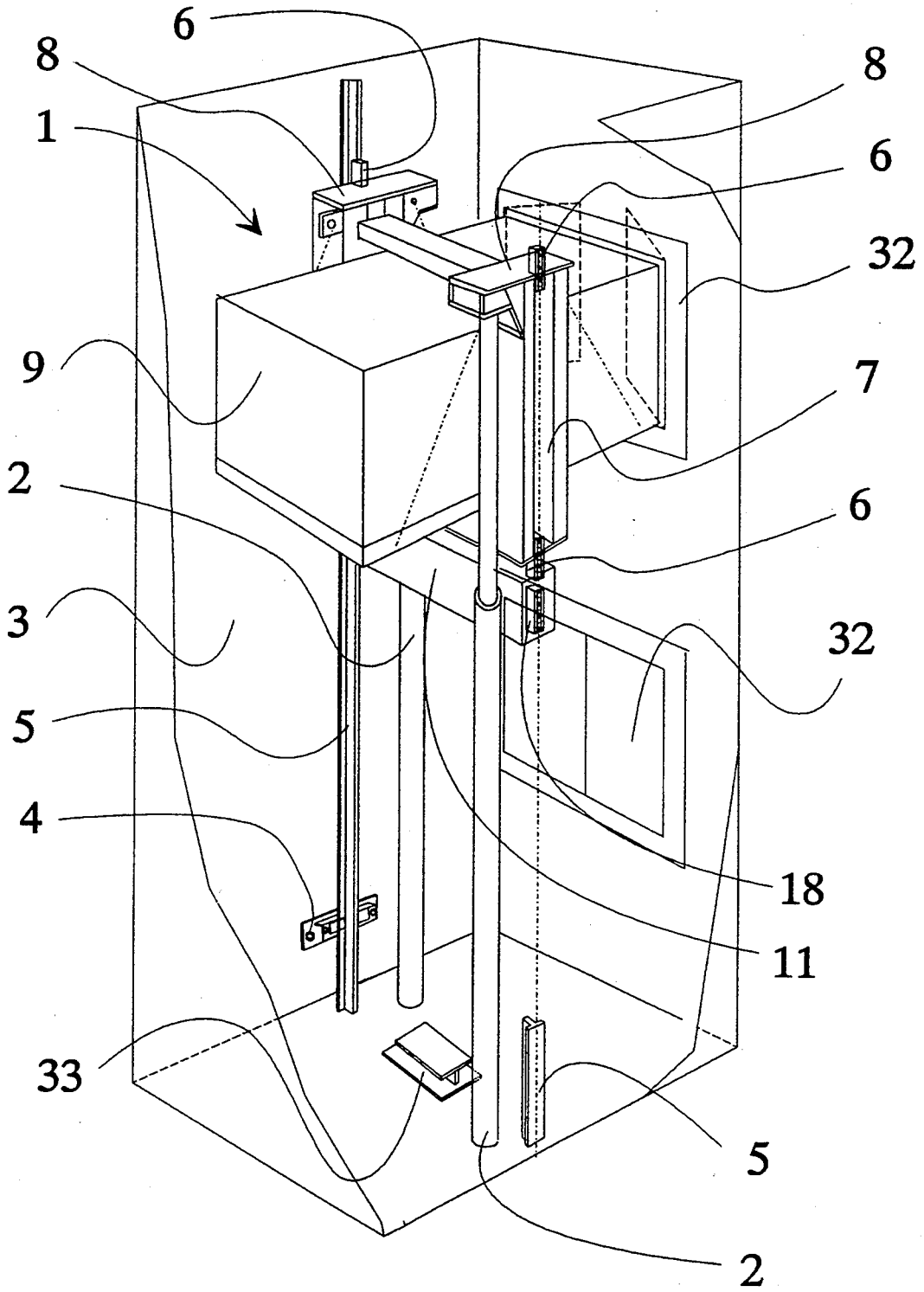
FIG. 4 shows the elevator with a frame beam and stopper of the invention.

FIG. 3 shows the arrester 10 in end view. The frame of the arrester consists of three beams 27,28 joined together so that they form a frame with a cross-section resembling the letter H. Attached by their lower ends to the beam constituting the transverse part of the H-profile are the buffer elements 13, whose upper ends are fixed to the bottom beam structure 12 of the car frame. Placed at each end of the arrester frame is a plate 29 to which the sliding guide shoes 18 and the latch frames 30 are attached. The latches 20 are turnably mounted in the latch frames. The lever 24, joined by one end to a projection 31 provided on the axle 23, turns the latch about the latch joint, moving it to the arrest position or to the travel position, depending on the direction of the lever motion. As the buffer elements 13 are placed inside the H-profile frame, it is generally unnecessary to provide the arrangement with a separate motion limiter to prevent buffer element compression exceeding the designed amount, but if desirable, e.g. when non-conventional buffer elements are used, it is possible to provide the arrester frame e.g. with flat-iron stoppers (not shown) of a suitable height, placed on top of the frame at either end.

It is obvious to a person skilled in the art that different embodiments of the invention are not restricted to the examples described above, but that they may instead be varied within the scope of the claims below. For example, the stop blocks could be attached to the guide rails or to the rail clamps instead of to the shaft walls. The lowest landing need not necessarily be provided with stop blocks for the latches, but this landing, or the bottom of the shaft, may be provided with a stopper 33 designed to receive the frame beam or some other fixed part of the arrester. This would correspond to a buffer arrangement resembling the conventional case, using buffers placed at the bottom of the car instead of on the bottom of the shaft. The safety device arrangement can also be applied to other types of elevator besides hydraulic elevators for goods transport. Instead of the separate buffer elements presented in the examples, it would be possible to use a rather large, compressible filler block of a continuous or nearly continuous structure, placed between the car frame and the arrester.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A safety device arrangement for stopping downward drift of an elevator car, the elevator car having a car supporting frame inside which the elevator cabin is fitted, the elevator travels in an elevator shaft, means for moving the elevator in the elevator shaft being attached directly to the car supporting frame, the arrangement comprising:

a controllable arrester mounted on the supporting frame of the elevator car;

at least one latch on the arrester;

at least one stop block being placed in the elevator shaft so as to be substantially immovable relative to the shaft, said at least one stop block acting as a detent for the at least one latch; and at least one buffer element between the arrester and the car supporting frame of the elevator car, resulting supporting forces are passed between the car supporting frame and the arrester substantially only through the at least one buffer element when the elevator car rests on the at least one latch engaged by the at least one stop block.

2. The safety device arrangement according to claim 1, wherein the at least one stop block is provided for each landing of the elevator, said stop blocks being attached either to a wall of the elevator shaft or to elevator guide rails.

3. The safety device arrangement according to claim 1, wherein the at least one stop block is provided for each landing of the elevator except for a lowest landing, said stop blocks being attached either to a wall of the elevator shaft or to elevator guide rails.

4. The safety device arrangement according to claim 1, further comprising a stopper placed below a lowest landing, the stopper being engageable with a part of the arrester other than the at least one latch on the arrester.

5. The safety device arrangement according to claim 1, wherein the arrester is mounted below the elevator car and wherein a plurality of buffer elements and a plurality of latches are provided, the buffer elements being placed between a frame beam of the arrester and a bottom beam of the supporting frame of the elevator car, one end of the buffer elements being attached to the bottom beam of the supporting frame while another end of the buffer elements are attached to the frame beam of the arrester, the safety device further comprises:

binders for determining a largest distance between the arrester and the bottom beam of the supporting frame, the binders being placed around the arresters, each of the binders comprises a flat bar placed on top of the bottom beam of the supporting frame and another flat bar placed under the arrester and two tie bolts connecting the flat bars, said bolts passing by sides of the bottom beam of the supporting frame and the arrester such that there is at least one bolt on each side of the bottom beam of the supporting frame and the arrester;

each end of the arrester is provided with a sliding guide shoe mounted to follow a guide rail, the elevator having guide shoes which also follow the guide rail;

lifting magnets for actuating the latches, the lifting magnets being provided on each side of the arrester; and spindles, axles and levers connecting the lifting magnets to the latches such that upon activation of the lifting magnets, the latches are moved to a travel position and upon deactivation of the magnets, the latches are moved to a rest position, the spindles being connected to the lifting magnets, the levers being connected to the latches and the axles being connected between the spindles and levers, the latches engaging the at least one stop block in the rest position.

6. The safety device arrangement according to claim 5, wherein four latches are provided, two of the latches being provided on each side of the arrester.

7. The safety device arrangement according to claim 5, wherein the rest position of the latches is a rest position of the arrester, the safety device arrangement further comprises a return spring mounted to urge the latches to the rest position, the lifting magnets upon activation overcoming the urging of the spring to thereby move the latches to the travel position.

8. The safety device arrangement according to claim 1, wherein the arrester is mounted below the elevator car and wherein a plurality of buffer elements are provided, the buffer elements being placed between a frame beam of the arrester and a bottom beam of the supporting frame of the elevator car, one end of the buffer elements being attached to the bottom beam of the supporting frame while another end of the buffer elements are attached to the frame beam of the arrester.

9. The safety device arrangement according to claim 1, further comprising binders for determining a largest distance between the arrester and a bottom beam of the supporting frame, the binders being placed around the arresters, each of the binders comprises a flat bar placed on top of the bottom beam of the supporting frame and another flat bar placed under the arrester and two tie bolts connecting the flat bars, said bolts passing by sides of the bottom beam of the supporting frame and the arrester such that there is at least one bolt on each side of the bottom beam of the supporting frame and the arrester.

10. The safety device arrangement according to claim 1, wherein each end of the arrester is provided with a sliding guide shoe mounted to follow a guide rail, the elevator having guide shoes which also follow the guide rail.

11. The safety device arrangement according to claim 1, wherein a plurality of latches are provided and further comprising;

lifting magnets for actuating the latches, the lifting magnets being provided on each side of the arrester; and spindles, axles and levers connecting the lifting magnets to the latches such that upon activation of the lifting magnets, the latches are moved to a travel position and upon deactivation of the magnets, the latches are moved to a rest position, the spindles being connected to the lifting magnets, the levers being connected to the latches and the axles being connected between the spindles and levers, the latches engaging the at least one stop block in the rest position.

12. The safety device arrangement according to claim 1, wherein a plurality of latches are provided and further comprising;

lifting magnets for actuating the latches, the lifting magnets being provided on each side of the arrester; and means for connecting the lifting magnets to the latches such that upon activation of the lifting magnets, the latches are moved to a travel position and upon deactivation of the magnets, the latches are moved to a rest position whereat the latches engage the at least one stop block.

13. The safety device arrangement according to claim 12, wherein the means for connecting comprises spindles, axles and levers, the spindles being connected to the lifting magnets, the levers being connected to the latches and the axles being connected between the spindles and levers.

14. A safety device arrangement for stopping downward drift of an elevator car, the elevator car having a supporting frame inside which the elevator cabin is fitted, the elevator travels in an elevator shaft, the arrangement comprising:

a controllable arrester mounted on the supporting frame of the elevator car;

at least one latch on the arrester;

at least one stop block being placed in the elevator shaft so as to be substantially immovable relative to the shaft, said at least one stop block acting as a detent for the at least one latch, the at least one stop block being provided for each landing of the elevator except for a lowest landing, said stop blocks being attached either to a wall of the elevator shaft or to elevator guide rails; and at least one buffer element between the arrester and the supporting frame of the elevator car, resulting supporting forces are passed between the supporting frame and the arrester substantially only through the at least one buffer element when the elevator car rests on the at least one latch engaged by the at least one stop block.

15. A safety device arrangement for stopping downward drift of an elevator car, the elevator car having a supporting frame inside which the elevator cabin is fitted, the elevator travels in an elevator shaft, the arrangement comprising:

a controllable arrester mounted on the supporting frame below the elevator car;

at least one latch on the arrester;

at least one stop block being placed in the elevator shaft so as to be substantially immovable relative to the shaft, said at least one stop block acting as a detent for the at least one latch;

at least one buffer element between the arrester and the supporting frame of the elevator car, resulting supporting forces are passed between the supporting frame and the arrester substantially only through the at least one buffer element when the elevator car rests on the at least one latch engaged by the at least one stop block;

a plurality of buffer elements and a plurality of latches being provided, the buffer elements being placed between a frame beam of the arrester and a bottom beam of the supporting frame of the elevator car, one end of the buffer elements being attached to the bottom beam of the supporting frame while another end of the buffer elements are attached to the frame beam of the arrester:

binders for determining a largest distance between the arrester and the bottom beam of the supporting frame, the binders being placed around the arresters, each of the binders comprises a flat bar placed on top of the bottom beam of the supporting frame and another flat bar placed under the arrester and two tie bolts connecting the flat bars, said bolts passing by sides of the bottom beam of the supporting frame and the arrester such that there is at least one bolt on each side of the bottom beam of the supporting frame and the arrester;

each end of the arrester is provided with a sliding guide shoe mounted to follow a guide rail, the elevator having guide shoes which also follow the guide rail;

lifting magnets for actuating the latches, the lifting magnets being provided on each side of the arrester; and spindles, axles and levers connecting the lifting magnets to the latches such that upon activation of the lifting magnets, the latches are moved to a travel position and upon deactivation of the magnets, the latches are moved to a rest position, the spindles being connected to the lifting magnets, the levers being connected to the latches and the axles being connected between the spindles and levers, the latches engaging the at least one stop block in the rest position.

16. The safety device arrangement according to claim 15, wherein four latches are provided, two of the latches being provided on each side of the arrester.

17. The safety device arrangement according to claim 15, wherein the rest position of the latches is a rest position of the arrester, the safety device arrangement further comprises a return spring mounted to urge the latches to the rest position, the lifting magnets upon activation overcoming the urging of the spring to thereby move the latches to the travel position.

18. A safety device arrangement for stopping downward drift of an elevator car, the elevator car having a supporting frame inside which the elevator cabin is fitted, the elevator travels in an elevator shaft, the arrangement comprising:

a controllable arrester mounted on the supporting frame of the elevator car;

at least one latch on the arrester;

at least one stop block being placed in the elevator shaft so as to be substantially immovable relative to the shaft, said at least one stop block acting as a detent for the at least one latch;

at least one buffer element between the arrester and the supporting frame of the elevator car, resulting supporting forces are passed between the supporting frame and the arrester substantially only through the at least one buffer element when the elevator car rests on the at least one latch engaged by the at least one stop block;

a plurality of latches;

lifting magnets for actuating the latches, the lifting magnets being provided on each side of the arrester; and means for connecting the lifting magnets to the latches such that upon activation of the lifting magnets, the latches are moved to a travel position and upon deactivation of the magnets, the latches are moved to a rest position whereat the latches engage the at least one stop block.

19. The safety device arrangement according to claim 18, wherein the means for connecting comprises spindles, axles and levers, the spindles being connected to the lifting magnets, the levers being connected to the latches and the axles being connected between the spindles and levers.

* * * * *